US007131225B2

(12) United States Patent
Wu

(10) Patent No.: US 7,131,225 B2
(45) Date of Patent: Nov. 7, 2006

(54) FOLDING CHAIR

(76) Inventor: Henry Wu, 23441 Golden Springs Dr. #370, Diamond Bar, CA (US) 91765

( * ) Notice: Subject to any disclaimer, the term of this patent is extended or adjusted under 35 U.S.C. 154(b) by 0 days.

(21) Appl. No.: 10/452,957

(22) Filed: Jun. 3, 2003

(65) Prior Publication Data

US 2003/0196356 A1 Oct. 23, 2003

Related U.S. Application Data

(62) Division of application No. 09/943,483, filed on Aug. 29, 2001.

(60) Provisional application No. 60/271,122, filed on Feb. 23, 2001.

(51) Int. Cl.
*G09F 3/00* (2006.01)

(52) U.S. Cl. ..... 40/320; 40/606.08; 40/666

(58) Field of Classification Search ..... 40/320, 40/606.08, 607.14, 611.06, 611.12, 611.13, 40/651, 666, 308, 640, 652; 297/217.1; 248/301, 248/305

See application file for complete search history.

(56) References Cited

U.S. PATENT DOCUMENTS

| | | | | |
|---|---|---|---|---|
| 133,503 | A | 11/1872 | Travis et al. | |
| 192,770 | A | 7/1877 | Lacomme et al. | |
| 202,856 | A | 4/1878 | Morse et al. | |
| 277,272 | A | 5/1883 | Hale | |
| 937,567 | A | 10/1909 | Canouts | |
| 941,135 | A | 11/1909 | De Moulin | |
| 1,176,915 | A | 3/1916 | Loveless | |
| 1,304,753 | A | 5/1919 | Dwyer | |
| 1,344,498 | A * | 6/1920 | Fox | 281/44 |
| 1,355,669 | A | 10/1920 | Henry | |
| 1,395,153 | A | 10/1921 | Schomacker | |
| 1,424,031 | A | 7/1922 | Peters | |
| 1,550,068 | A | 8/1925 | Golden | |
| 1,616,975 | A * | 2/1927 | Knopp | 40/611.06 |
| 1,639,085 | A | 8/1927 | Fohey | |
| 1,678,691 | A * | 7/1928 | De La Cuesta et al. | 40/320 |
| 1,682,047 | A * | 8/1928 | Lang et al. | 40/320 |
| 1,689,070 | A | 10/1928 | Elliott | |
| 1,728,731 | A * | 9/1929 | Hayes | 40/542 |
| 1,815,643 | A | 7/1931 | Allerding | |
| 1,833,177 | A | 11/1931 | Rice | |
| 1,838,213 | A | 12/1931 | Buffington | |
| 1,847,605 | A | 3/1932 | Fitzgerald | |

(Continued)

FOREIGN PATENT DOCUMENTS

| | | |
|---|---|---|
| GB | 146005 | 7/1920 |
| GB | 2 098 471 A | 11/1982 |

*Primary Examiner*—Joanne Silbermann
(74) *Attorney, Agent, or Firm*—Knobbe Martens Olson & Bear, LLP

(57) ABSTRACT

A sign holding device for a folding chair that allows the user to display customized messages on a back rest of the chair. The sign holder is attached to the back rest in various manners so as to permit messages to be displayed when the chair is unfolded. The sign holders are configured such that when the chair is folded, the chair can be carried and stacked without having to remove the sign holders from the back rest. One embodiment of the folding chair also includes an integral carrying handle that permits the folded chair to be carried by one hand. The integral carrying handle further comprises an opening that permits the carrying hand to grasp the handle better, and also permit the chair to be unfolded without removing the hand from the handle, such that the unfolding action does not pinch the carrying hand.

7 Claims, 12 Drawing Sheets

U.S. PATENT DOCUMENTS 1,900,486 A 3/1933 Clarin
2,125,488 A 8/1938 Colie
2,131,586 A 9/1938 Dano
2,390,878 A 12/1945 Greitzer
2,517,433 A 8/1950 Hoven et al.
2,587,543 A 2/1952 Smith
2,694,442 A 11/1954 Nordmark
2,767,895 A 10/1956 Smith
2,802,578 A 8/1957 Barile
2,828,803 A * 4/1958 Howe et al. ..... 297/333
2,876,566 A * 3/1959 Harrington ..... 40/320
2,920,687 A 1/1960 Hurley
2,973,803 A 3/1961 Mickelson
3,021,175 A 2/1962 Norquist
3,025,101 A 3/1962 McKinnie
3,283,433 A 11/1966 Navarino
3,431,022 A 3/1969 Poppe et al.
3,471,197 A 10/1969 Ely
3,649,074 A 3/1972 McDonald et al.
3,695,687 A * 10/1972 Uyeda ..... 297/56
3,703,312 A 11/1972 Chapman
3,825,302 A 7/1974 Kurtz
4,117,613 A 10/1978 Hosker
4,566,735 A 1/1986 Frobose
4,619,207 A 10/1986 Boyce et al.
4,682,816 A 7/1987 Massonnet
4,747,011 A 5/1988 Lissner
4,884,353 A 12/1989 Taylor
4,936,033 A * 6/1990 Lacko ..... 40/765
5,064,247 A 11/1991 Clark et al.
5,096,259 A 3/1992 Stanfield
5,167,436 A 12/1992 Wu
5,329,716 A 7/1994 Fite
5,707,107 A 1/1998 Melone
5,738,408 A 4/1998 Wu
5,779,317 A 7/1998 Neal
5,785,222 A * 7/1998 Basso et al. ..... 224/555
6,006,462 A 12/1999 Lackomar
6,092,866 A 7/2000 Wu

* cited by examiner

FOLDING CHAIR

RELATED APPLICATIONS

This application is a divisional of U.S. application Ser. No. 09/943,483 filed Aug. 29, 2001 entitled "FOLDING CHAIR". This application claims the benefit of U.S. Provisional Application No. 60/271,122 filed Feb. 23, 2001 entitled "APPARATUS FOR CUSTOMIZING THE BACK OF A CHAIR".

BACKGROUND OF THE INVENTION

1. Field of the Invention

The present invention relates to folding chairs and method of customizing messages on the back rest of the folding chair and improved carrying characteristics.

2. Description of the Related Art

Folding chairs are well known in the art. They typically consist of two sets of legs that are pivotally attached. A seat is also pivotally attached to the legs such that when the legs are separated, the seat is horizontal to the ground and can thus support a user. Typically, the back set of legs have a back rest that extends therebetween.

Folding chairs are used for many different public gatherings. Some common gatherings include weddings, political conventions and the like. In these types of gatherings, the chairs are often rented either from the meeting facility itself or a rental agency. When not in use, folding chairs are typically folded and stacked together. The ease of storage and portability in large numbers make folding chairs ideal for large gatherings. The folding chairs can be easily set up in various manner to meet the seating requirements of the gathering. Often, the chairs are placed in uniform rows where individuals sit.

Prior to individuals sitting down, the chairs present a uniform boring appearance. This uniform boring appearance may detract from the desired sentiment of the public gathering. For example, a uniform sea of gray or white chairs may appear too austere for guests arriving for a political gathering or a wedding. To address these needs, it may be desirable to place custom messages on the chairs. A congratulatory message might be appropriate for a wedding, for example. In a political gathering, a message of support for a candidate can enhance the atmosphere.

Also, an organizer of a gathering event may wish to have seating assignments to make the event more meaningful. For example, the organizer may want to reserve the front row seats for important guests. In another example, a banquet organizer might assign guests selectively to various tables. Needs such as these are met by placing an appropriate reservation messages on chairs.

However, placing custom messages on chairs is often difficult, especially if there are large number of chairs. Painting or otherwise writing on the chairs result in the message being permanently inscribed on the chairs. This is unacceptable if the chairs are to be re-used for a different event, or if the chairs are rental properties. A message such as a wedding congratulation for one couple is, of course, not suitable for a subsequent wedding for other people. A similar problem can occur in a location where political gatherings are held.

Existing methods of customizing messages on chairs are time consuming or result in messages that are easily displaced. Messages or seat assignments printed on loose pieces of papers can easily find their way to the ground as litter. Banners can be temporarily attached to the chairs, but this can be time consuming and usually must be done at the event location after the chairs have been set up. Moreover, the temporary nature of the attachment allows the message to be easily dislodged by guests or participants arriving at the public location. Loose papers or banners falling apart all lead to unsightly appearances to the gathering.

There exist methods of placing temporary messages on the backs of chairs. One is card holding frame disclosed in U.S. Pat. No. 1,550,068 to Golden. This card holding device is secured on the upper edge of the seat back. This card holding frame has its lower edge recessed to fit upon the upper edge of the seat back. Once in place, a card with customized messages can be inserted and removed. The drawback to this method is that frame protrudes above and beyond the top of the chair's back. At large gatherings the folding chairs are usually placed in rows spaced closely. A typical folding chair has a back frame angling upwards and backwards. Thus, having extra protrusions toward the row behind can cause more crowding, and the frames can be bumped easily. Furthermore, people often grab onto the tops of chairs for support as they walk between the rows. Because of the temporary nature of the attachment, grabbing the protruding frames for support can cause them to become dislodged. Frames that fall on the floor will again lead to unsightly appearance to the gathering, and may even become safety hazards.

Another method is in the form of a chair back cover disclosed in U.S. Pat. No. 1,304,753 to Dwyer. Made of fabric, this device drapes an appropriately shaped fabric over the chair's back, thus covering the front and rear surfaces. A provision is made such that a printed program or a seat number card can be inserted and displayed. This chair cover is secured in place by strings tied along the lower edge of the seat's back. This invention, intended to provide decorative covers for fixed furniture, has several drawbacks. First, securing this cover is time consuming, with all the tying and untying of knots. This is a problem especially when large number of chairs must be covered for temporary use. Second, to maintain sanitary conditions, these fabric covers must be laundered frequently. This is especially true in warm climates where perspiration is common. The process of repeated laundering accelerates the wear and shortens the useful life-span of the cover. Third, a spillage of food or drink will stain the fabric, thus rendering it cosmetically unusable at many events.

From the foregoing, it will be appreciated that there is a need for a folding chair that is capable of displaying interchangeable message signs in a simple, economical, and safe manner. To this end, there is a need for a message sign displaying device that can be easily prepared, installed, and removed from folding chairs, and in large numbers if necessary. Furthermore, this message sign displaying device should be safe to use and not alter the functionality of the chair that it is attached to. Furthermore, the sign displaying device should be durable and be maintained easily for repeated use.

SUMMARY OF THE INVENTION

The aforementioned needs are satisfied by a sign displaying device of the present invention. In one embodiment of the present invention, a sign holder for a folding chair having a back rest portion, consists of a main body with an aperture through its front and rear surfaces, a plurality of retainers for securing the main body to the back rest, and at least one sign card retainer on the rear side of the main body for securing a sign card to the rear side of the main body. The sign card has a message inscribed on it such that when attached to the sign holder, and the sign holder is attached to the back rest, the message is visible through the aperture by an observer from the front of the folding chair.

In this embodiment, the main body and the plurality of retainers are preferably constructed of plastic such that the plurality of retainers form contiguous extensions from the main body. These retainers have hook shapes biased toward the rear surface of the main body. Furthermore, these retainers and the main body are flexible and resilient to allow urging of the hook shaped retainers into engagement with the top and bottom edges of the back rest portion of the folding chair. Once attached to the folding chair, the sign holder is contoured to the back rest portion so as to retain the functional profile of the folding chair.

Furthermore, the sign holder has at least one sign card retainer on the rear surface of the main body. The sign card retainer is formed of plastic and is formed to allow insertion of the sign card and secure the sign card on the rear side of the main body.

Another embodiment of the sign displaying device of the present invention comprises a padded sign, the padded sign comprising a main body with front and rear surfaces, a plurality of retainers that allow the padded sign to be attached to the back rest portion of the folding chair, and a padding attached to the main body on which a message can be inscribed. The main body and the plurality of retainers are constructed and attached to the back rest in a manner described above. Preferably, the padding is attached to the main body of the padded sign by stapling the padding on the rear side of the main body such that the padding on the front side of the main body comprises a contiguous area on which message can be inscribed.

A combination of the folding chair and the sign displaying device is one aspect of the present invention, wherein the folding chair with the sign displaying device has dimensions substantially similar as a folding chair without the sign displaying device. Because of this, the folding chair with the sign displaying device can be folded and unfolded without removing the sign displaying device from the back rest. Furthermore, the plurality of folding chairs in folded configuration with sign displaying devices attached can be stacked together for storage purpose.

The folding chair with the sign displaying device can be sat on by a user, and the user's back can be supported by the back rest portion with the sign displaying device in place. The folding chair with the sign displaying device, when not sat on, displays a message to enhance the appearance of the folding chair. Furthermore, plurality of such folding chairs with sign displaying devices display plurality of messages to enhance the overall atmosphere of the gathering for which the folding chairs are being used.

In another aspect of the invention, a folding chair comprises a first frame member having a first and a second leg. The chair further comprises a second frame member having a first and a second leg. The first and second frame members are pivotally connected so as to be pivotable between the folded and unfolded position. The chair further comprises a seat member coupled to the first frame member. The seat member is pivotally attached to the first frame member so as to be pivotable between the folded and unfolded configuration. The chair further comprises a horizontal brace extending between the first and second legs of the second frame member so as to provide horizontal support therebetween. The horizontal brace includes an opening dimensioned to receive a user's hand, and the horizontal brace is positioned at a vertical location adjacent the vertical location of the seat.

In one embodiment, the seat has a rear edge that abuts the horizontal brace when in the unfolded configuration. The opening is dimensioned such that the user's hand is removed from the interface between the rear edge of the seat and the horizontal brace. In one embodiment, the horizontal brace is located at the same vertical level as the seat. The vertical level of the horizontal brace yields sufficient clearance between the floor and the bottom of the chair when the user picks up the chair by the horizontal brace and carries the chair with an extended arm so as to improve the comfort of carrying the chair.

In one embodiment, the chair further comprises a back rest extending between the first and second legs of the first frame member. The first frame member comprises the front frame member and the second frame member comprises a back frame member. The first and second frame members, the horizontal brace and the seat members are made of plastic. The horizontal brace is proximate the center of mass of the chair such that when the chair is grasped at the horizontal brace, the chair can be held and controlled in an improved manner.

Another aspect of the invention relates to a folding chair having a folded and unfolded configuration, wherein the chair comprises a first frame member having a first and a second leg. The chair further comprises a second frame member having a first and a second leg. The first and second frame members are pivotally connected so as to be pivotable between the folded and unfolded position. The chair further comprises a seat member coupled to the first frame member. The seat member is pivotally attached to the first frame member so as to be pivotable between the folded and unfolded configuration.

The chair further comprises a horizontal brace extending between the first and second legs of the second frame member so as to provide horizontal support therebetween. The horizontal brace is located near the bottom of the second frame member so as to allow a user's foot to push down when the chair is being folded. The chair further comprises a back rest attached to the top portion of the first frame member.

The back rest defines an opening dimensioned to receive the user's hand. The chair can be folded by one hand positioned in the opening pulling upward on the back rest while one foot keeps the chair down by pushing down on the horizontal brace. The front portion of the seat member swings towards-the back rest as the chair, is being folded. The opening prevents the hand from being pinched between the seat member and the back rest as the chair is being folded. In one embodiment, the opening is a half moon shaped cutout on the bottom edge of the back rest.

From the foregoing, it should be apparent that the sign displaying device of the present invention allows displaying interchangeable signs on the back rest portion of the folding chair. It will be appreciated that when the sign displaying devices are used on large number of folding chairs, such as in large gatherings, the usefulness of the sign displaying devices becomes more apparent. These and other objects and advantages of the present invention will become more apparent from the following description taken in conjunction with the accompanying drawings.

DETAILED DESCRIPTION OF THE PREFERRED EMBODIMENT

Figure 1:
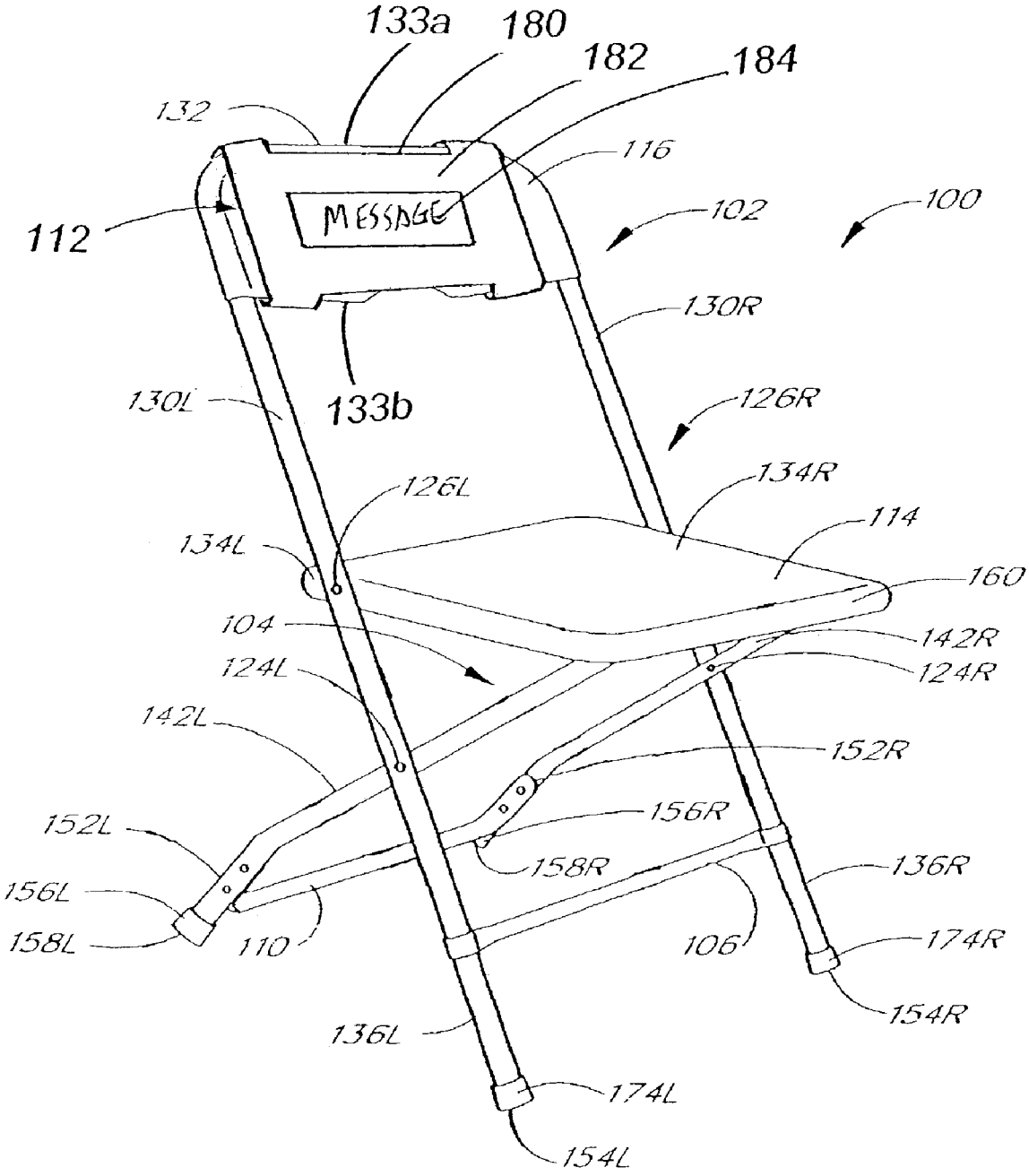
FIG. 1 is a view of a sign holder of one embodiment of the invention installed on a folding chair with the folding chair shown in an opened position.
Figure 2:
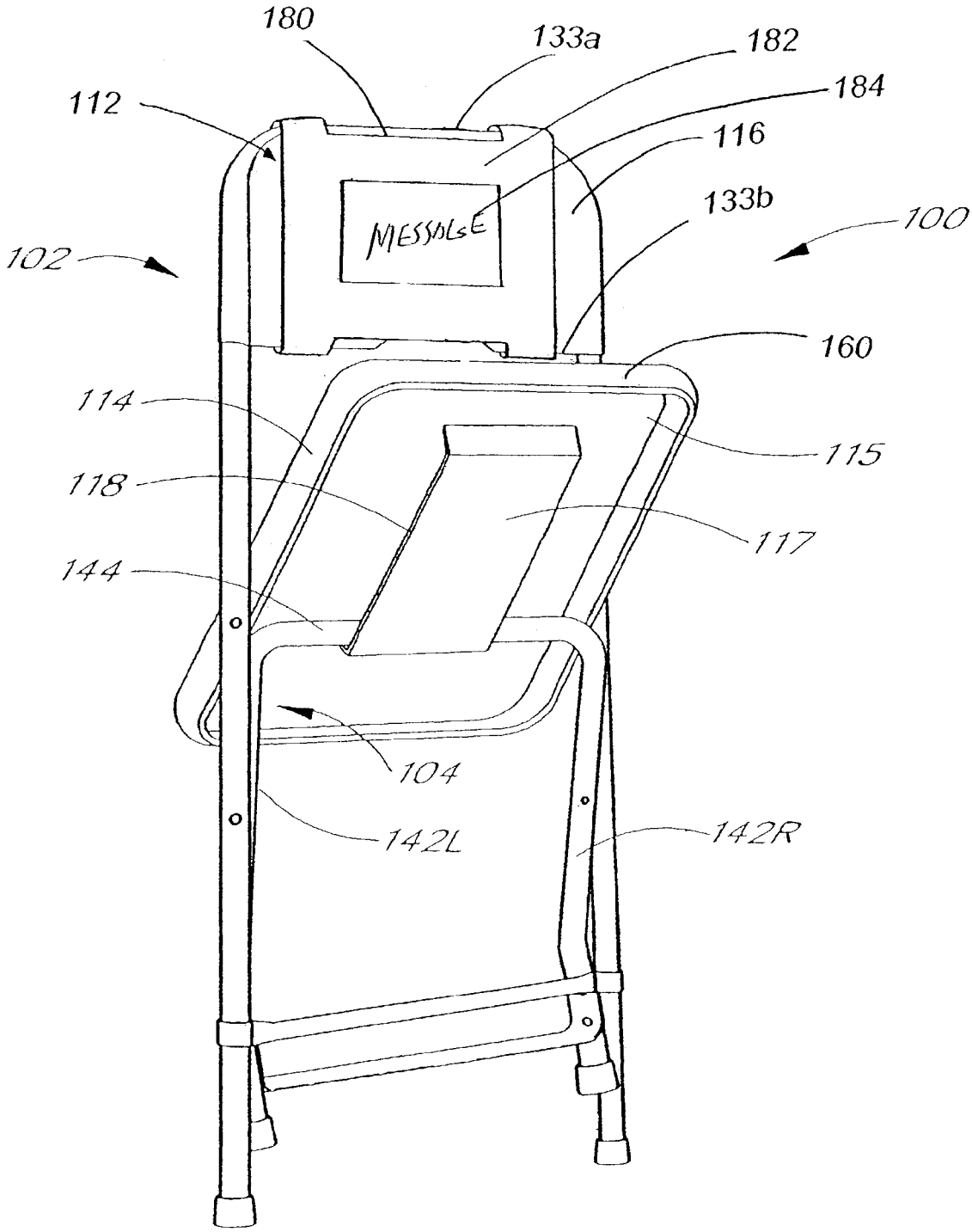
FIG. 2 is a view of the sign holder of one embodiment of the invention installed on the folding chair with the folding chair shown in a closed position.

Reference will now be made to the drawings wherein like numerals referred like parts through out. FIG. 1 illustrates the components of an opened folding chair 100 with a sign holder 112 of one embodiment of the invention attached. FIG. 2 illustrates the components of the folding chair 100, with the sign holder 112 attached, in a closed position.

The folding chair 100 is comprised of two pivotally connected U-shaped sections 102, 104 that are coupled to a seat rest 114 in a manner described below. The first U-shaped section 102 contains a left side section 130L, a lateral section 132 that extends orthogonally from the left section 130L, and a right side section 130R that extends orthogonally from the lateral section 132 to complete the U-shape of the section 102. In this description, the left side section 130L is on the left side of the folding chair 100 as defined by an observer looking at the front of the folding chair 100. The lower parts of the sections 130L, 130R serve as a pair of front legs 136L, 136R with front bottom edges 154L, 154R. The bottom edges are covered with a pair of protective front shoes 174L, 174R that are adapted to provide non-slip contact with the floor so as to maintain the folding chair 100 in place.

The first U-shaped section 102 further contains a back rest 116. The back rest 116 is adapted to attach to the first U-shaped section 102 adjacent to the lateral section 132 in a manner that allows the back rest 116 to be supported by sections 130L, 132 and 130R in a manner that is known in the art. The purpose of the back rest 116 is to allow the user to obtain a comfortable sitting position and to prevent the user from falling out of the folding chair 100 in a backward direction. The sign holder 112 is attached to the back rest 116 in a manner described below. The back rest 116 is situated substantially higher than the rest of the folding chair 100 so as to allow the sign holder 112 to be substantially visible.

The first U-shaped section 102 further contains a front brace 106 that connects the left and right sections 130L, 130R together at locations adjacent to the legs 136L, 136R. The purpose of the front brace 106 as to provide lateral support to the first U-shaped section 102 so as to maintain the front legs 136L and 136R a first distance from each other that is selected to provide stability for the folding chair 100.

The second U-shaped section 104 contains a left section 142L, a lateral section 144 (see FIG. 2) that extends orthogonally from the left section 142L, and a right section 142R that extends orthogonally from the lateral section 144 to form the U-shape of the section 104. The left and right sections 142L, 142R contain a plurality of slight bends that enable the folding chair 100 to fold up in a compact manner as described below. The lateral section 144 is situated under the seat rest 114 as shown in FIG. 2 in a manner which is further described below. The lower parts of sections 142L, 142R serve as a pair of rear legs 152L, 152R with rear bottom edges 158L, 158R. The bottom edges are covered with a pair of protective rear shoes 156L, 156R that are adapted to provide non-slip contact with the floor so as to maintain the folding chair 100 in place.

The second U-shaped section 104 further contains a rear brace 110 that connects to the left and right rear legs 152L, 152R together. The purpose of the rear brace 110 is to provide lateral support to the second U-shaped section 104 so that the rear legs 152L and 152R are maintained a first distance part from each other that is selected so as to provide stability for the folding chair 100.

The two U-shaped sections 102, 104 are pivotally attached at a pair of central pivot points 124L, 124R that coincide with the side sections 130L, 130R and 142L, 142R of the U-shaped sections 102, 104 respectively. The U-shaped sections 102, 104 are attached to each other in a manner that allows the sections 102, 104 to be aligned in a common plane when the chair 100 is in a folded or closed position. In addition, the U-shaped sections 102, 104 are attached to each other in a manner that allows the sections 102, 104 to be tilted with respect to each other such that the lateral section 144 of the second U-shaped section 104 supports the front of the folding chair 100 and the lateral section 132 of the first U-section 102 supports the backrest 116 of the chair 100 when the chair is in an unfolded or open position.

The seat rest 114 is pivotally attached at a pair of rear corners 134L, 134R to a pair of pivot points 126L, 126R located on the first U-shaped section 102. The seat rest 114 is adapted to support the weight of the user when the user is seated in the chair 100. As shown in FIG. 2, a guideplate 117 is attached to a bottom surface 115 of the seat rest 114 to ensure that the seat rest is supported at the front edge 160 when the folding chair 100 is in an open position. In particular, the lateral section 144 of the second U-section 104 is interposed between the guideplate 117 and the seat rest 114 so that the lateral section 144 is captured within a slot 118 that is formed between the bottom surface 115 and the guideplate 117. The lateral section 144 is movable within the slot 118 so that, when the user unfolds the folding chair 100 by placing the seat rest 114 into a horizontal position in a manner described below, the guideplate 117 directs the lateral section 144 of the second U-section 104 to be positioned adjacent the front edge 160 of the seat rest 114.

In a fully open position, the U-shaped sections 102, 104 are extended to a maximum angular displacement that is limited by the contact between the front edge 160 of the seat rest 114 and the lateral section 144 of the second U-section 104 as shown in FIG. 1. In a corresponding manner, the front legs 136L, 136R and rear legs 152L, 152R are simultaneously extended from each other to form a solid base of support for the folding chair 100. With the folding chair 100 unfolded in the foregoing manner and placed on a level solid surface with all four legs 136L, 136R and 152L, 152R touching the surface, the seat rest 114 of the folding chair 100 provides a horizontal sitting surface that is capable of supporting the weight of the user.

FIGS. 1 and 2 illustrate the sign holder 112 attached to the back rest 116 of the folding chair 100 in its folded and unfolded positions. The back rest 116 comprises a top edge 133*a* and a bottom edge 133*b* to facilitate attachment of the sign holder 112 in a manner described below. The sign holder 112 has a main body 180 whose dimensions conform to the dimensions of the back rest 116. The main body 180 has a front surface 182, a rear surface 194 (illustrated in FIG. 4), and an aperture 184 that extends through the front surface 182 and the rear surface 194. The aperture 184 allows a message inscribed on a sign card 202 to be visible from the front of the folding chair in a manner described below. The sign card 202 is attached to the sign holder 112 in a manner described below.

Figure 3:
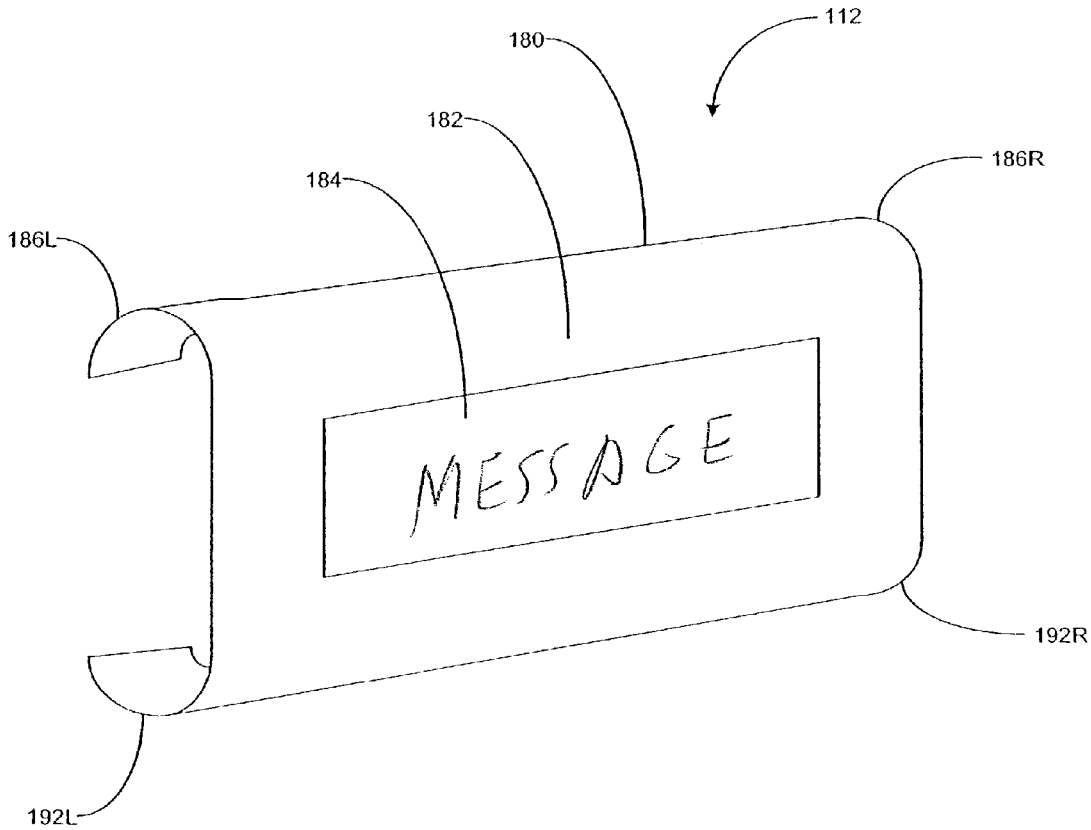
FIG. 3 is a perspective view of the sign holder of one embodiment of the invention.

The sign holder 112 has a plurality of retainers to allow the sign holder 112 to be attached to the back rest 116. FIG. 3 illustrates one embodiment of the present invention. A left top retainer 186L extends from the left top corner of the main body 180, and a right top retainer 186R extends from the right top corner of the main body 180. In this description, the left top retainer 186L is on the left top corner of the main body 180 such that when attached to the back rest 116, the left top corner of the main body 180 coincides with the left top corner of the back rest 116 as defined by an observer looking at the front of the folding chair 100. A left bottom retainer 192L and a right bottom retainer 192R extend from the bottom left and right corners of the main body 180. The retainers 186L, 186R, 192L, 192R are preferably shaped like a hook and are biased toward the rear surface 194 of the main body 180 as shown in FIGS. 3 and 5.

In one embodiment of the invention, the main body 180 and the retainers 186L, 186R, 192L, 192R are fabricated from plastic such that the retainers 186L, 186R, 192L, 192R form contiguous extensions from the main body 180. Furthermore, the main body 180 and the retainers 186L, 186R, 192L, 192R are flexible so as to allow the user to urge the retainers 186L, 186R, 192L, 192R into engagement with the top edge 133*a* and the bottom edge 133*b* of the back rest 116. Conversely, the sign holder 112 can be removed from the back rest 116 by urging the retainers 186L, 186R, 192L, 192R out of engagement with the top edge 133*a* and the bottom edge 133*b* of the back rest 112.

Figure 4:
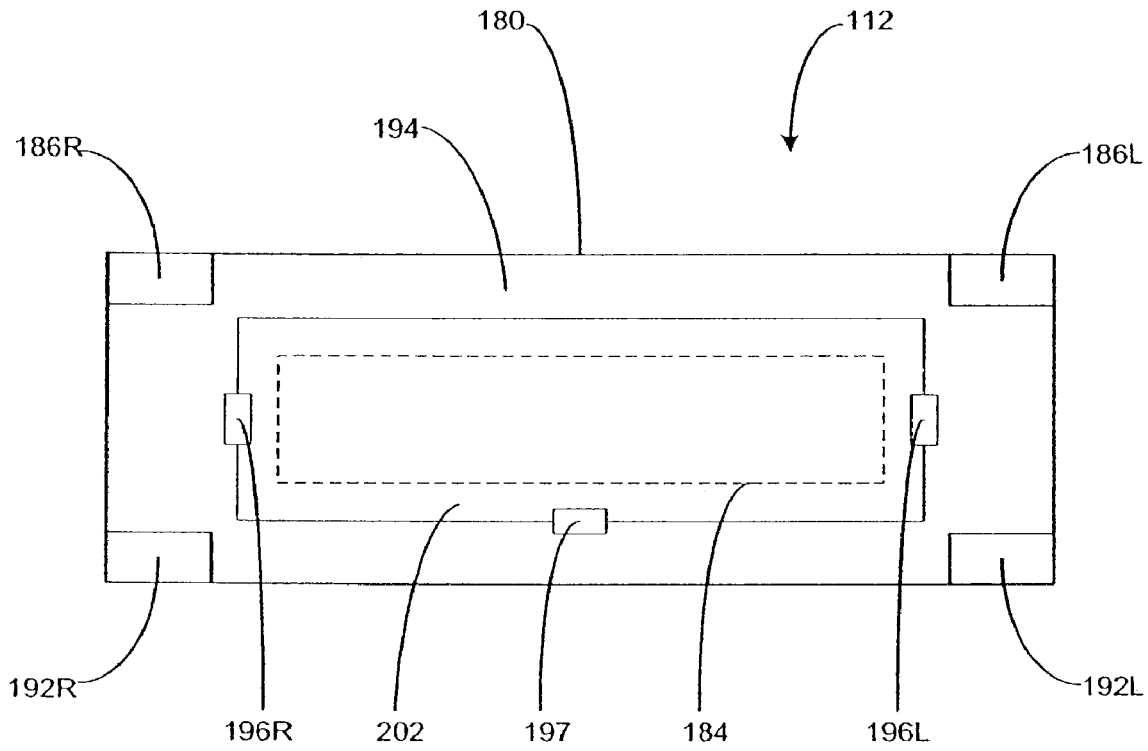
FIG. 4 is a plan view showing a rear surface of the sign holder of one embodiment of the invention.

FIG. 4 shows the rear surface 194 of the sign holder 112. On the rear surface 194 is at least one sign card retainer. In one embodiment of the invention, shown in FIG. 4, sign card retainers 196L, 196R are located near the left and right edges of the aperture 184. A sign card retainer 197 is located near the center of the bottom edge of the aperture 184. The sign card retainers 196L, 196R and 197 allow the sign card 202 to be secured on the rear surface 194 of the sign holder 112 such that the message printed on the sign card 202 is visible from the front of the folding chair 100 through the aperture 184.

Figure 5:
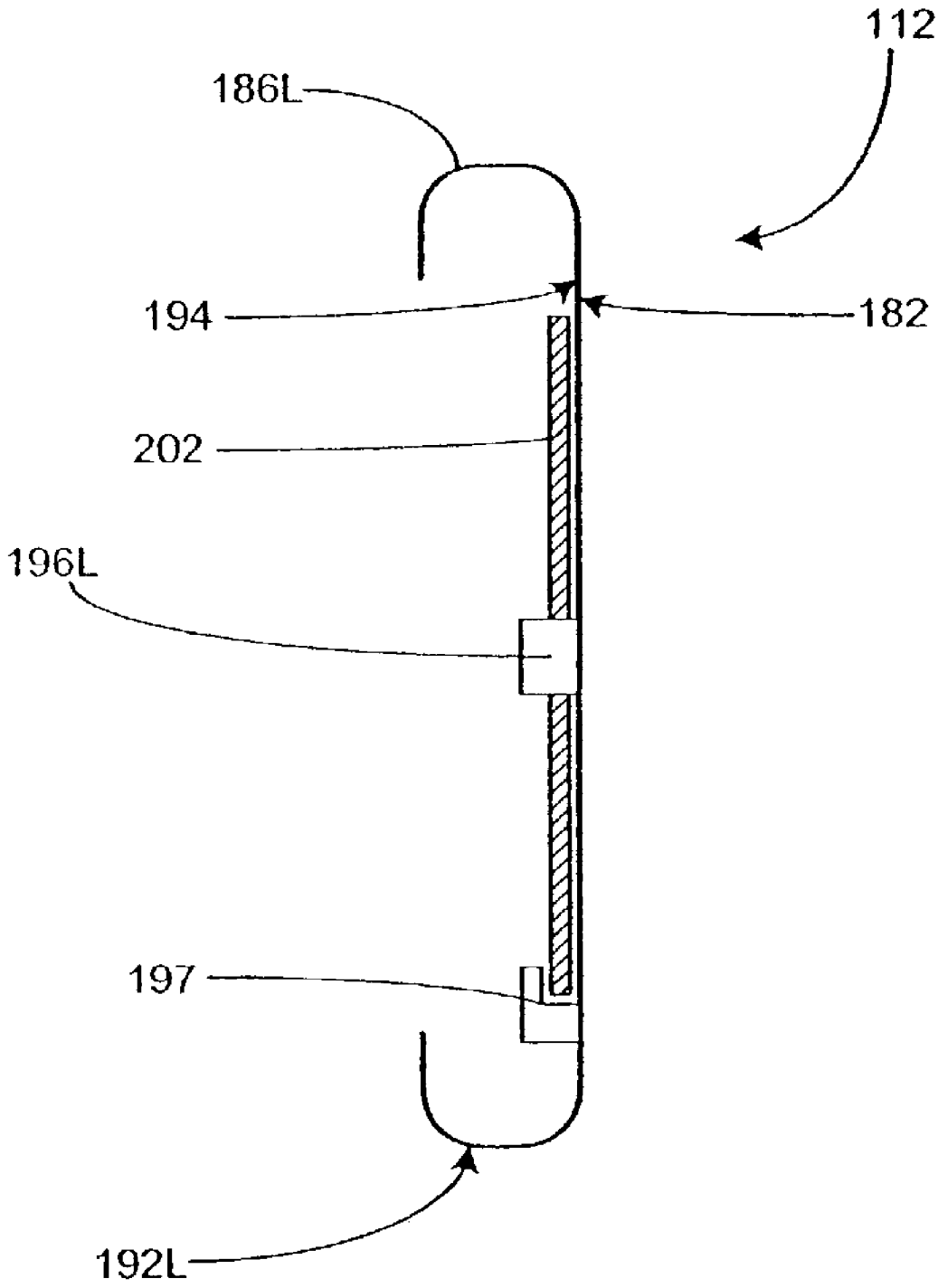
FIG. 5 is a side view of the sign holder of one embodiment of the invention.

FIG. 5 shows a side view of the sign holder 112 and further illustrates the sign card 202 secured onto the rear surface 194 by the card retainers 196L (196R not shown) and 197. It will be appreciated that the drawing is not to scale, and the sizes of the sign card 202 and the card retainers 196L, 197 have been exaggerated for illustrative purpose. In one embodiment of the invention, the card retainers 196L, 196R, and 197 are sized so as to make the sign holder 112 substantially conform to the back rest 116 in a manner described below.

In use, the user takes the sign card 202 inscribed with a customized message, and inserts the sign card 202 into the sign card retainers 196L, 196R, 197 on the rear surface 194 of the sign holder 112. The sign card 202 is secured on the rear surface 194 by the sign by the card retainers 196L, 196R, 197 such that the inscribed message on the sign card 202 is adjacent to the aperture 184 so as to make the message visible through the aperture 184 when viewed from the front of the folding chair 100. The sign card retainers 196L, 196R prevent the sign card 202 from moving sideways when the sign card 202 is attached to the rear surface 194. The sign card retainer 197 prevents the sign card 202 from moving down when the sign card 202 is attached to the rear surface 194.

The sign holder 112, with the sign card 202 secured, is attached to the back rest 116 of the folding chair 100 by the retainers 186L, 186R, 192L, 192R. One method of attachment is to first hook the top retainers 186L and 186R to the top edge 133*a* of the back rest. Then, the main body 180 and the bottom retainers 192L and 192R can be flexed to allow the bottom retainers 192L and 192R to hook onto the bottom edge 133*b* of the back rest 116. The main body 180 and the retainers 186L, 186R, 192L, 192R then contours to the shape of the back rest 116 such that the sign holder 112 does not significantly alter the original profile or the function of the back rest 116.

The folding chair 100 with the sign holder 112 attached can be folded as shown in FIG. 2 and be stacked for storage. Or, the folding chair 100 with the sign holder 112 attached can be unfolded as shown in FIG. 1 for use, where the user can sit on the folding chair 100 and have the user's back supported by the back rest 116 with the sign holder 112 attached. Furthermore, when the user is not sitting on the folding chair 100, the message inscribed on the sign card 202 is visible through the aperture 184 on the sign holder 112. The operation described above may be repeated on a plurality of folding chairs 100 as needed.

In one embodiment of the invention, the sign holder 112 can be removed from the folding chair 100 by unhooking the retainers 186L, 186R, 192L, 192R from the top edge 133*a* and the bottom edge 133*b* of the back rest 116. The sign card 202 can be removed from the sign holder 112 by pulling out the sign card 202 out of the sign card retainer 196L, 196R, 197. A new customized message can be inscribed on a new sign card 202 for use as described above.

Figure 6:
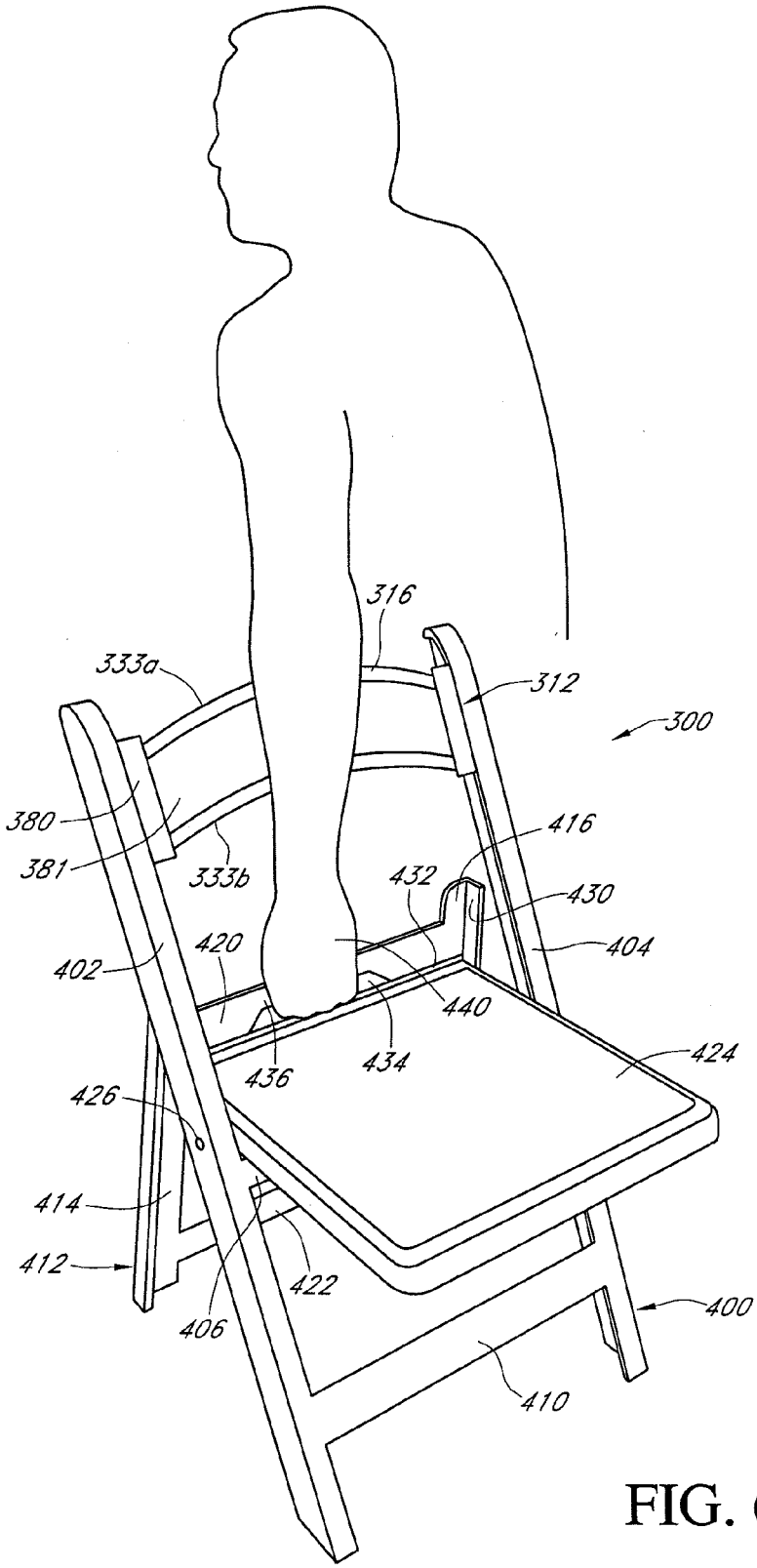
FIG. 6 is a perspective view of a padded sign attached to a folding chair as another embodiment of the invention, wherein the folding chair further comprises a carrying handle so as to permit a user to grasp the chair in an improved manner.

Another embodiment of the invention illustrated in FIG. 6, comprises a folding chair 300 wherein a padded sign 312 is attached to a back rest 316. The padded sign 312 comprises a main body 380 to which a padding 381 is attached to. The padded sign 312 is attached to the back rest 316 in a manner described above, wherein a plurality of hook shaped retainers hook onto top edge 333*a* and bottom edge 333*b*. Preferably, the main body 380 is fabricated from ¼ inch thick plastic, and the padding 381 is covered with vinyl on which a message can be inscribed. The padding 381 is preferably wrapped around the main body 380 and secured at the back of the main body by staples. The padded sign 312 can be attached and removed from the folding chair 300 in a manner described above. Furthermore, the folding chair 300 can be folded and stacked in a manner described above.

The folding chair 300 further comprises a front frame member 400 pivotally attached to a rear frame member 412, with both the front and rear frame members 400, 412 supporting a seat 424 in a manner described below. The front frame member 400 comprises first and second sections 402 and 404 that are interconnected near the top by the back rest 316, by a middle brace 406 near the middle, and by a bottom brace 410 near the bottom. The first and second sections 402 and 404 are substantially parallel to each other, and include pivots 426 that pivotally attach the first and second sections 402, 404 to side edges of the seat 424. When the folding chair 300 is in an open configuration, as in FIG. 6, the seat 424 is further supported by the top of the middle brace 406.

The rear frame member 412 comprises first and second sections 414 and 416 that are interconnected by a top brace 420 and a bottom brace 422. The rear frame member 412 is pivotally attached to the front frame member 400 by frame pivots 430 that attach top portions of the first and second sections 414, 416 of the rear frame member 412 to approximately middle portions of the first and second sections 402, 404 of the front frame member 400. When the folding chair 300 is in the open configuration, a grooved (not shown) rear edge of the seat 424 engages the bottom of the top brace 420 of the rear frame member 412. Thus, the engagement of the seat 424 with the middle brace 406 of the front frame member 400 and the top brace 420 of the rear frame member 420 inhibits further pivotal movement of the seat 424, front frame member 400, and the rear frame member 412, so as to permit a person to sit on the folding chair 300.

In one embodiment, the front and rear frame members 400 and 412 are made from molded plastic such that each frame member forms a contiguous piece. The first and second sections 402, 404 of the front frame member 400, and the first and second sections 414, 416 of the rear frame member 412 have cross sectional shapes that form right angles so as to provide the sections with strength to resist buckling.

The top brace 420 of the rear frame member 412 defines a cutout 434 at the bottom edge so as to form a carrying handle 436. FIG. 6 illustrates a person using a hand 440 to grasp the chair 300 by the handle 436 so as to be able to pick up the chair 300 and move it. It will be appreciated that the cutout 434 is sized to receive the hand 440 of the user such that the hand 440 does not get caught between the top brace 420 and the rear edge of the seat 424.

When the user wishes to move a traditional folding chair in an opened configuration, the chair is typically grasped near the top portion of the chair, either at the back rest (316 in FIG. 6), or the top portions of the first and second sections (402, 404 in FIG. 6). Grasping the chair 300 by the handle 436 makes it easier for the user to hold and control the chair 300 in either folded or unfolded configurations, due to the fact that the handle 436 is located close to the center of mass of the chair.

Furthermore, the vertical location of the handle 436 is substantially similar to that of the seat 424 such that when an average sized user picks up and holds the unfolded chair 300 with an extended arm, the clearance between the bottom of the chair and the floor is sufficient for improved maneuvering of the chair. If the same chair 300 is picked up by the back rest 316, the carrying arm may need to be bent to raise the chair 300 sufficiently to prevent the bottom of the chair 300 from dragging on the floor. Carrying a load with a bent arm is typically more physically demanding than carrying a load with an extended arm. Thus, the vertical location of the handle 436 improves the carrying characteristics of the chair 300.

Being able to hold and move the chair 300 in a controlled manner may be an important safety issue, especially for a user with a limited physical strength. Thus, the carrying handle 436 affords the user at least two safety features when using the chair 300. First is that the cutout 434 reduces the likelihood of the user's hand 440 being pinched between the top brace 420 and the seat 424. Second is that the handle's close proximity to the chair's center of mass permits the grasped chair to be handled in a easier manner.

Figure 7:
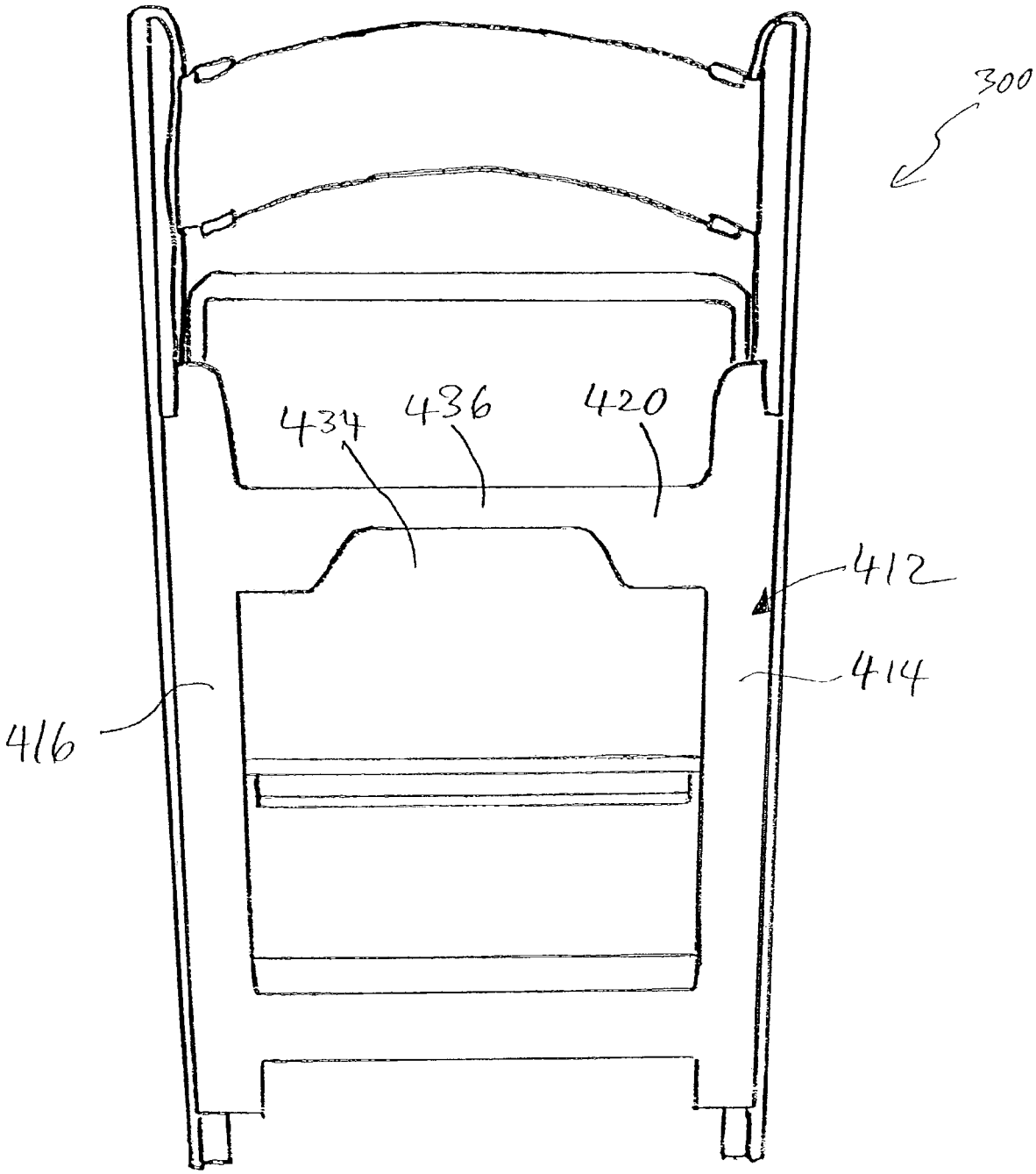
FIG. 7 is a rear view of the folding chair of FIG. 6 in a closed position.

FIG. 7 illustrates the orientation of the carrying handle 436 when the folding chair 300 is in its closed configuration. The carrying handle 436 is situated on the rear side of the folded chair 300, between the first and second sections 414, 416 of the rear frame member 412.

Figure 8A:
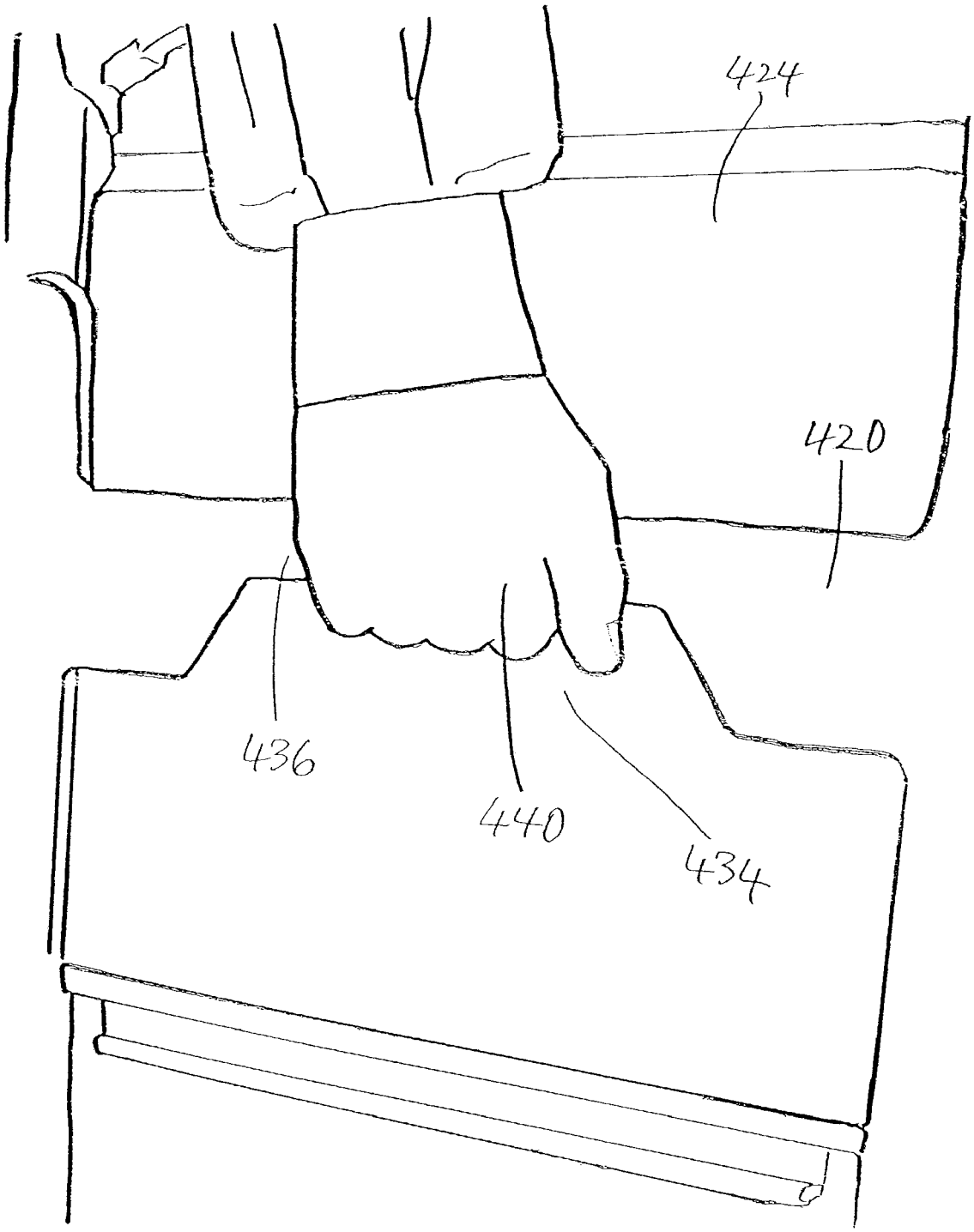
FIG. 8A illustrates how the folding chair of FIG. 6 in the closed position can be carried by the carrying handle.

As illustrated in FIG. 8A, the carrying handle 436 permits the folded chair 300 to be carried by a person. The person orients the chair 300 such that the seat 424 is interposed between the person's leg and a carrying hand 440. The chair 300 is picked up by the hand grasping the carrying handle 436 such that the fingers wrap around the carrying handle through the cutout 434 on the top brace 420. The reduced width of the carrying handle 436 permits easier grasping by the hand 440.

Figure 8B:
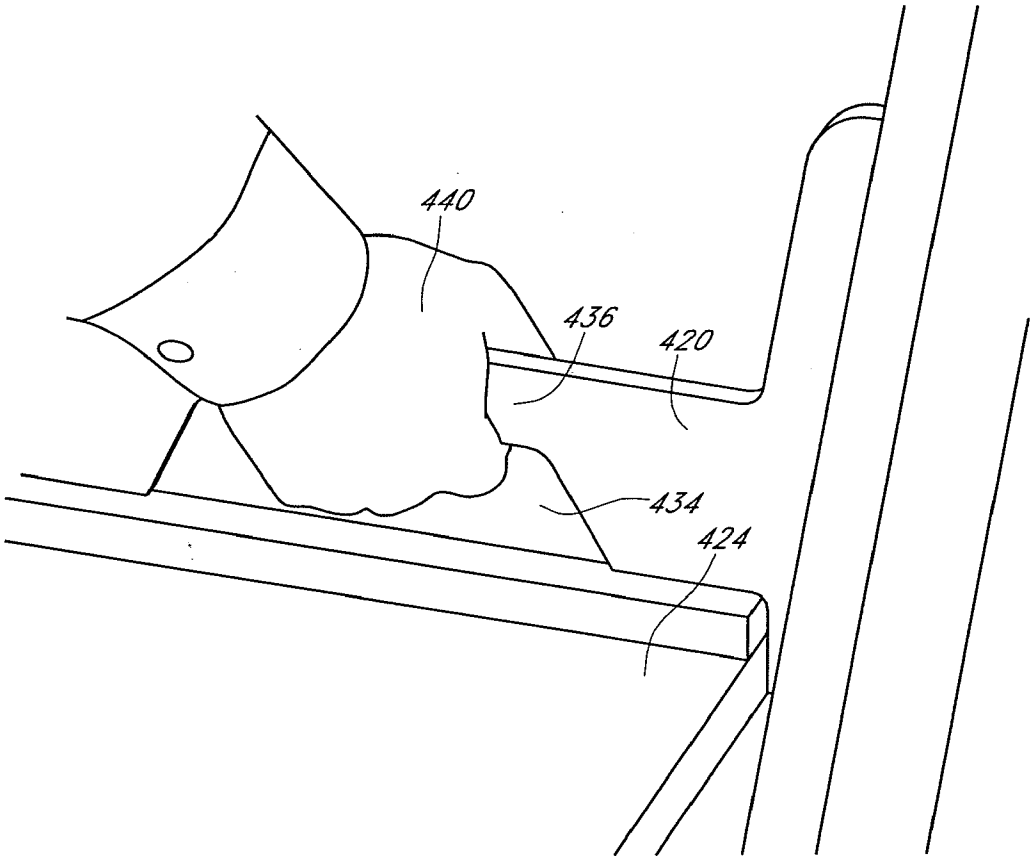
FIG. 8B illustrates how the carrying handle permits the unfolded chair to be carried without pinching of the carrying hand.

The cutout 434 further acts as a safety device when the chair 300 is unfolded to its open configuration, as illustrated in FIG. 8B. As the chair 300 is opened, the rear edge of the seat 424 swings towards the bottom edge of the top brace 420 of the rear frame member 412. As shown in FIG. 8B, the cutout 434 permits the hand 440 to retain its grasp of the carrying handle 436 without the fingers being pinched between the seat 424 and the top brace 420. Maintaining the grasp of the carrying handle 436 permits the person to unfold the folding chair 300 from the carrying position in a substantially continuous manner without having to change a hold on the chair 300. FIG. 8B is also an enlarged view of the hand 440 grasping the chair 300 in an unfolded configuration, similar to the chair holding described above in reference to FIG. 6.

Figure 9:
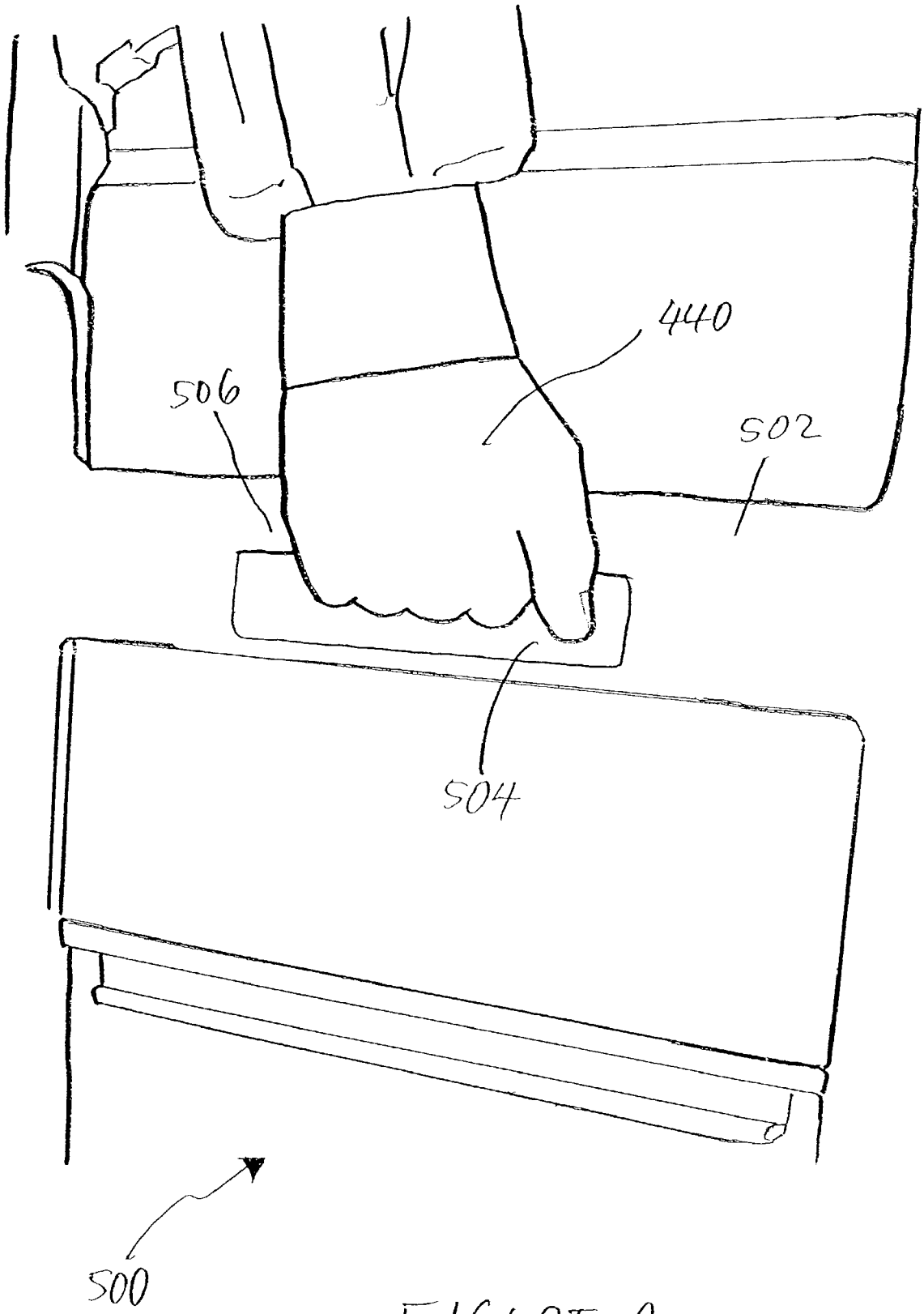
FIG. 9 illustrates another embodiment of the carrying handle, wherein the carrying handle is formed by an aperture that also permits the folding chair to be unfolded without pinching of the carrying hand.

In one embodiment, as illustrated in FIGS. 8A and 8B, the carrying handle 436 is formed on the top brace 420 by the cutout 434. In another embodiment, as shown in FIG. 9, folding chair 500 comprises a top brace 502 (of the rear frame member) that is similar to the top brace 420 of the chair 300 described above. The top brace 502 defines an aperture 504 positioned such that a carrying handle 506 is formed. The aperture 504 permits the fingers of the hand 440 to grasp the handle 506 and carry the folded chair 500. Furthermore, the aperture 504 also permits the folded chair 500 to be unfolded while maintaining the grasp of the carrying handle 506 without the fingers being pinched between the top brace 502 and the seat, thus offering similar advantages as that associated with the carrying handle 436 with the cutout 434 described above.

Figure 10A:
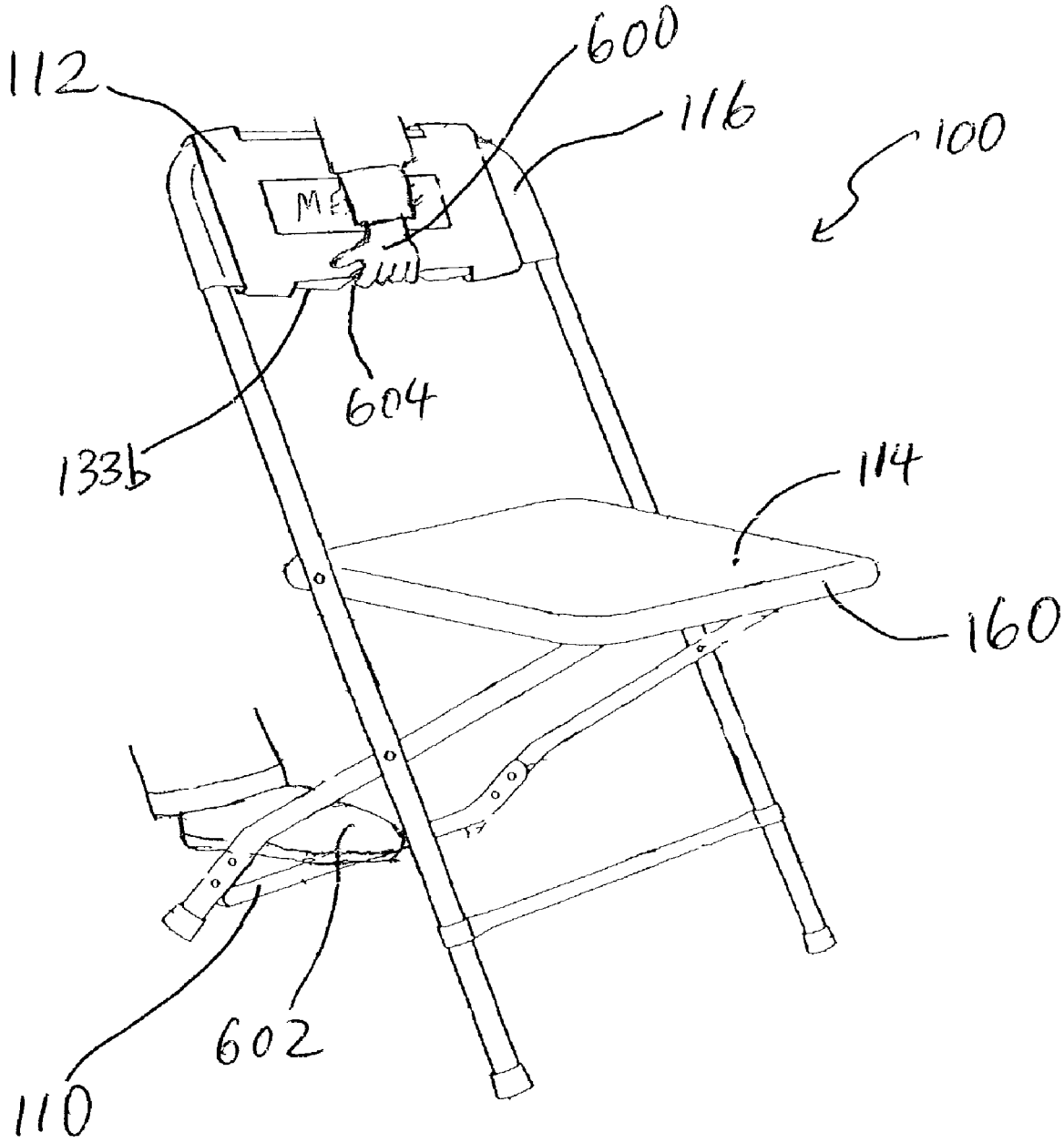
FIG. 10A illustrates another aspect of the folding chair of FIG. 1, wherein a cutout at the bottom of a back rest permits gripping of the back rest during a folding operation such that the gripping hand is not pinched by a seat member.
Figure 10B:
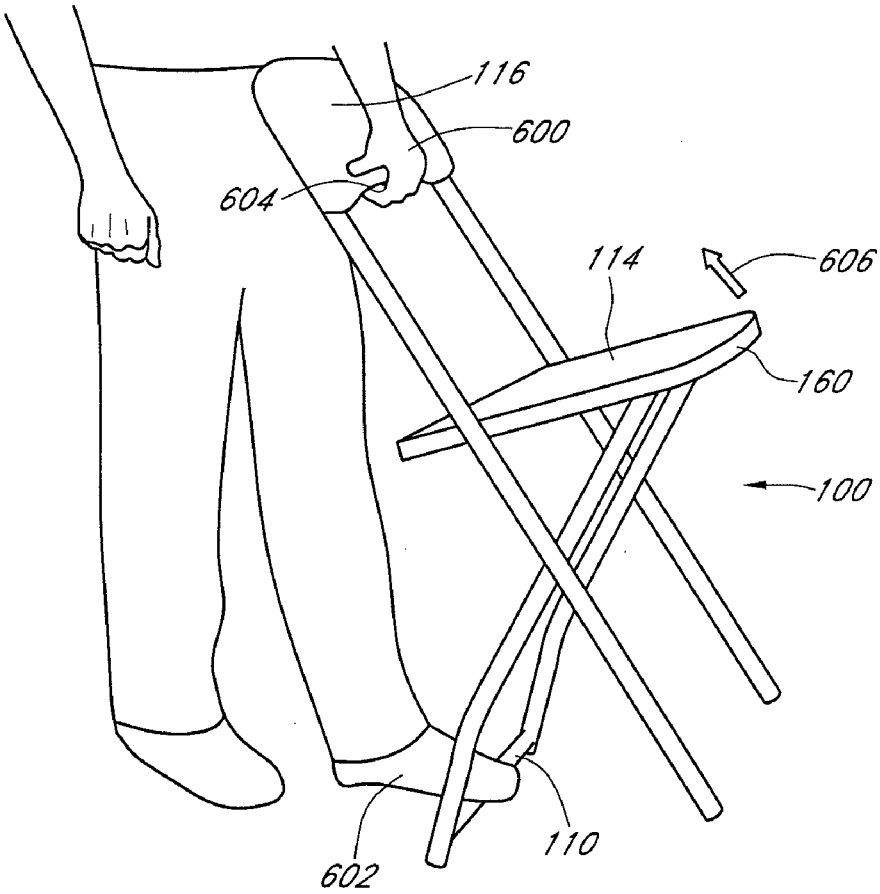
FIG. 10B illustrates the folding chair of FIG. 10A being folded by a user using a single hand and a foot.

Another aspect of the invention is illustrated in FIGS. 10A and 10B, wherein the folding chair 100 described above in reference to FIGS. 1 and 2 further comprises a cutout 604 defined at the bottom edge 133*b* of the back rest 116. The cutout 604 is sized to receive a gripping hand 600, allowing sufficient clearance such that when the chair 100 is folded with the gripping hand 600 gripping the cutout 604, the front edge 160 of the seat 114 does not pinch the hand 600 when the chair 100 is folded. The chair 100 can be folded by using one hand 600 and a foot 602 securing the rear brace 110 in a manner described below. The structure and function of the chair is described above in reference to FIGS. 1 and 2. The sign holder 112 may be adapted to expose the cutout 604 such that the hand 600 can grip the cutout 604 comfortably.

FIG. 10B illustrates the user in the process of folding the chair 100 using one hand 600 and one foot 602. The user grips the back rest 116 at the cutout 604 with the hand 600, and places the foot 602 on top of the rear brace 110. While the foot 602 pushes down on the rear brace 110 to inhibit the chair 100 from being lifted off the ground, the gripping hand 600 pulls the back rest 116 upward. Such a motion causes the chair 100 to be folded, with the front edge 160 of the seat 114 moving in an arc, as indicated by an arrow 606, towards the bottom edge 133*b* of the back rest 116. The hand 600, being within the cutout 604, is prevented from being pinched between the front edge 160 of the seat 114 and the back rest 116.

In one embodiment, the cutout 604 is shaped like a half moon so as to permit a smooth contour that can be gripped comfortably by the hand 600. It should be apparent to one of ordinary skill in the art that the cutout 604 may be shaped in any number of shapes without departing from the spirit of the invention.

It will be appreciated that the cutout 604 on the back rest 116 and the rear brace 110 permit the user to fold the chair 100 in an improved manner. In particular, the chair 100 can be folded in a safer manner by preventing the hand 600 from being possibly injured when pinched between the seat 114 and the back rest 116.

It will be appreciated that the sign displaying devices and the carrying handles described above provide the folding chairs with significant advantages while offering little or no significant drawbacks. In particular, the sign holding devices with messages printed, when attached to the folding chairs in various embodiments, provide a simple and an effective method of displaying customized signs at gatherings. Furthermore, the carrying handle that forms an integral part of the chair's frame permits the folded chair to be carried in a convenient manner, and be unfolded in a safe and efficient manner.

Although the embodiments of the invention have shown, described and pointed out the fundamental novel features of the invention as applied to these embodiments, it will be understood that various omissions, substitutions and changes in the form of the detail of the device illustrated may be made by those skilled in the art without departing from the spirit of the invention. Consequently, the scope of the invention should not be limited to the foregoing description, but should be defined by the appending claims.

What is claimed is:

1. A sign displaying apparatus comprising:

a folding chair having a pair of spaced legs and a seat portion and a back rest portion that extends between the spaced legs wherein the back rest portion provides support for a person's back when sitting on the seat portion wherein the back rest portion includes first and second edges that are located generally opposite from each other; and a sign holder comprising:

a main body having dimensions that conform to the dimensions of the back rest portion wherein the main body comprises a front surface and a rear surface, and wherein the front and rear surfaces define an aperture;

a plurality of integral retainers that extend contiguously from first and second edges of the main body wherein the plurality of integral retainers have hook shapes biased toward the rear surface of the main body so as to allow urging of the plurality of hook shaped retainers into engagement with the first and second edges of the back rest portion thereby attached to the main body for securing the main body of the sign holder to the back rest portion of the folding chair; and at least one sign card retainer formed on the rear surface of the main body such that the sign card retainer retains a sign card such that a message inscribed on the sign card is visible through the aperture in the main body when viewed from the front surface of the main body.

2. The apparatus of claim 1, wherein the sign holder attached to the back rest portion of the folding chair is contoured to the back rest portion so as to retain a functional profile of the back rest portion.

3. The apparatus of claim 1, wherein the first and second edges of the back rest portion correspond to top and bottom edges of the back rest portion respectively and wherein the first and second edges of the main body correspond to top and bottom edges of the main body such that the plurality of integral hook shaped retainers engage the top and bottom edges of the back rest portion.

4. The apparatus of claim 3, wherein the plurality of hook shaped retainers comprise two hooks that extend from the top edge of the main body and two hooks that extend from the bottom edge of the main body.

5. The apparatus of claim 4, wherein the two top hooks are positioned near the ends of the top edge of the main body, and the two bottom hooks are positioned near the ends of the bottom edge of the main body.

6. The apparatus of claim 5, wherein the at least one sign card retainer formed on the rear surface of the main body comprises receiving members disposed adjacent a bottom and two sides of the aperture such that the sign card can be inserted into the receiving members from the top of the main body.

7. The apparatus of claim 1, wherein the main body and the plurality of integral hook shaped retainers are formed from a sheet of plastic to provide flexibility and resilience in repeated installation and removal of the sign holder to and from the back rest portion.

* * * * *